United States Patent [19]

Flider

[11] Patent Number: 4,552,288

[45] Date of Patent: Nov. 12, 1985

[54] AUTOMATIC VENTING SEALING CAP

[75] Inventor: Frank S. Flider, Mattoon, Ill.

[73] Assignee: Justrite Manufacturing Company, Des Plaines, Ill.

[21] Appl. No.: 550,605

[22] Filed: Nov. 10, 1983

[51] Int. Cl.[4] ..... B67D 3/00

[52] U.S. Cl. ..... 222/482; 222/556; 222/562; 220/203; 220/209

[58] Field of Search ..... 137/588, 846, 849; 220/314, 209, 203; 222/482, 481, 478, 517, 556, 562

[56] References Cited

U.S. PATENT DOCUMENTS

| | | | |
|---|---|---|---|
| 1,671,287 | 5/1928 | Hoeser et al. | 220/314 |
| 2,651,440 | 9/1953 | Hobbs | 222/478 X |
| 2,748,997 | 6/1956 | Richmond, Sr. | 222/562 X |
| 3,064,668 | 11/1962 | Alkire et al. | 222/482 X |

*Primary Examiner*—Joseph J. Rolla

*Assistant Examiner*—David H. Bollinger

*Attorney, Agent, or Firm*—Irwin C. Alter

[57] ABSTRACT

A sealing cap is provided for use in conjunction with safety storage containers and the like, which provides automatic venting and relief of interior vacuum, including low interior pressure resulting from contraction of the contents of the storage container, and from removal of liquid contents from the container. The cap provides a secure closure for a first opening in the container through which contents may be added or removed, while simultaneously providing the aforedescribed venting function. Incorporation of the present invention with a storage container having a second fluid dispensing opening avoids the necessity of providing an alternate or specialized air vent to admit air and prevent a vacuum build-up during dispensing of the contents. In one embodiment, the device is particularly immune to the effect of corrosive fluids stored within the container.

7 Claims, 4 Drawing Figures

AUTOMATIC VENTING SEALING CAP

BACKGROUND OF THE INVENTION

The present invention relates in general to storage container sealing caps, and in particular to an improved sealing cap for safety storage containers incorporating automatic vacuum relief venting.

Containers designed and intended for the safe storage, handling and dispensing of fluids, particularly volatile or corrosive fluids, must provide many functions. A typical storage container for use in connection with such fluids may provide separate openings for filling and for dispensing, such as a first large accessible opening for easy and safe filling and a second smaller controlled opening for safe dispensing. Typical configurations include Type II safety dispensing cans which may include a flexible hose outlet for controlled and directed delivery of volatile or corrosive fluids, and laboratory shelf or tilt cans with top or bottom mounted dispensing valves.

Satisfactory operation of such dispensing cans requires that provision be made for admitting air into the interior of the can in order to replace the fluid contents as they are removed by pouring or otherwise and thereby maintain an equal pressure between the interior of the container and the ambient atmosphere exterior to the container. Failure to provide such pressure equalization may result in a rising vacuum within the container and an influx of air through the dispensing hose or valve, interrupting the fluid flow and causing uncontrolled splashing and surges of dispensed fluid. Collapse of the container may also occur.

In order to avoid such conditions, separate air vent openings between the interior of the container and the exterior of the container may be provided. For example, it is known to provide for a small separate opening with a manually sealable cap, such as a flip-top vent opening. The operator must open this auxiliary vent prior to dispensing, and must then reseal the opening to provide for safe storage and transportation. Other forms of manual venting are also known.

In order to avoid such manual vent operation, it is known to provide a vent which is operated by the same activating means used to control the dispensing outlet or valve. For example, an operating trigger which controls a fluid dispensing valve may simultaneously operate a second vent valve positioned to admit air to the interior of the container. Such arrangements provide increased safety and security by assuring that the vent opening or valve is closed when the fluid is not being dispensed, such as during storage. The necessity for providing a mechanical linkage and a separate vent opening through the container, however, add to the complexity and cost of the resulting storage container.

It is further desirable to provide such storage containers with means for automatically equalizing the interior and exterior pressure in response to an interior vacuum created by the contraction of the container contents, or by increases in the exterior ambient pressure. Failure to provide such automatic relief may result in a partial collapse of the container. Such operation is generally not provided by the manual vent discussed, or by the dispensing trigger operated vent.

In order to provide for an improved and economical safety storage container, it is therefore desirable to provide a system which may simultaneously provide the sealing and venting functions described, without requiring specialized containers or mechanical linkages. Accordingly, it is an object of the present invention to provide a sealing cap for a fill opening of a fluid storage container which provides for automatic relief of an interior partial vacuum when the fluid contents of the container are dispensed through a second dispensing opening. A related object is to provide for automatic relief of an internal partial vacuum in the container without the need for manual operation or mechanical linkage to a dispensing trigger mechanism.

A further object is to provide for adequate venting of internal partial vacuum without requiring a specialized or additional vent opening in the associated container.

A further object is to provide an integrated sealing cap and partial vacuum venting system for use in conjunction with standard safety storage containers. A specific object is to provide such an automatic venting cap for use in conjunction with standard metal or plastic Type I and type II safety storage containers, including the common "jerry" can. Yet a further specific object is to provide such an integrated sealing and venting cap in conjunction with a laboratory dispensing can, designed either for shelf use with a bottom mounted dispensing valve, or for tilt stand use with a second top dispensing valve.

A further object is to provide such a partial vacuum venting valve assembly which is particularly immune to the effects of corrosive fluids in the storage container.

Another object is to provide such an integrated venting and sealing cap which is designed to use with existing sealing cap mounting apparatus.

These and other objects of the present invention will become apparent in light of the following specifications.

SUMMARY OF THE INVENTION

The present invention comprises an automatic vacuum venting sealing cap for use in conjunction with storage containers for fluids and other materials, and in particular for use in conjunction with safety storage containers. Such containers typically include an opening in the upper surface of the container for introduction of contents into the hollow interior of the container. Such an opening is generally surrounded by a raised collar with a smooth lip or upper edge, so that the collar defines a fill spout. The sealing cap is designed to cooperate with this fill spout and provide a sealed covering of the spout to prevent leakage or spillage of the contents through the spout during storage and transportation. In this regard, the present invention includes a cover plate whose outer or perimeter dimensions are at least equal to the outer or perimeter dimensions of the top edge of the fill spout collar, so that the cover will extend at least over the opening defined by the fill spout collar.

In order to facilitate an improved seal between the cover and the lip of the fill spout, a sealing gasket is included on the inner surface of the cover such that the gasket is located between the upper edge of the fill spout and the cover of the cap when the cap is engaged with the fill spout. A mounting means is included with the sealing cap for connecting the cover to a mounting bracket which secures the cap to the container and maintains the cap in sealing engagement with the fill spout during storage and transportation.

The improvement of the present invention includes providing a vacuum relief venting system in conjunction with such a sealing cap so that the cap may perform both a safety sealing function and an automatic vacuum venting function. A valve means is incorporated into the sealing cap so that the valve will permit passage of air in a first direction corresponding to a flow of air from the atmosphere exterior to the container into the interior of the container, while preventing a reverse flow of vapors or fluid from the interior of the container to the exterior. Passage of air from the exterior atmosphere to the valve may be permitted by providing an air passageway through the cap mounting means. The passageway includes a first open end communicating with the atmosphere exterior to the container, and a second open end associated with the sealing cap and communicating with the valve means. In this manner, when a partial vacuum exists in the container, air may pass through the first open end of the passageway through the passageway in the connecting means, through the second open end to the valve, and thereafter through the valve in a forward direction into the interior of the container to relieve the vacuum. Finally, the cap may include a mechanical protective casing for the valve elements to prevent accidental damage to the valve by foreign objects.

In one specific embodiment of the invention, the valve means comprises a flexible reed or "duckbill" valve element formed of flexible material such as rubber. The open end of the reed valve cooperates with the air passageway in the connecting means as previously described to define a one-way air passageway for admission of air from the atmosphere into the container in response to a partial vacuum. The reed valve element may be securely mounted by means of a protective cylindrical shroud including at its upper end means for engaging the flanged mounting end of the reed valve element, such that a vapor tight seal results between the valve element and the protected and mounting shroud. By incorporating a substantially vapor impermeable flexible covering extending over the gasket of the cap and integrated with the mounting shroud in a vapor type fashion, a venting sealing cap results which is substantially vapor tight and impervious to corrosive materials when constructed of suitable corrosion resistant plastics. The flexible gasket covering and the protective shroud may comprise a single continuous plastic member to optimize sealing and corrosion resistance.

Such improved venting sealing caps may be utilized to provide improved safety storage and dispensing containers. For example, a container having a first opening defining a fill spout as previously described may be provided, wherein a second opening for controllably dispensing the fluid contents is also provided. In such a configuration, the present invention may profitably operate to relieve the partial internal vacuum generated as the contents are removed from the container during dispensing, by admitting air to replace the volume of fluid dispensed. A container thus results which permits smooth and safe dispensing of fluids without the necessity of providing separate manual or mechanically operated venting valves, and in which the previously described automatic partial vacuum venting features are provided.

DETAILED DESCRIPTION OF THE DRAWINGS

Figure 1:
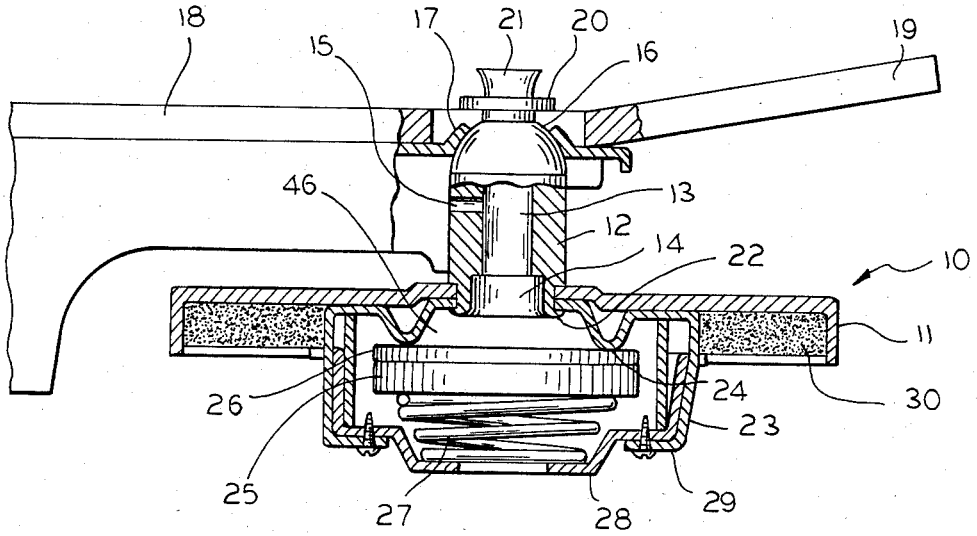
FIG. 1 is a cross-sectional view of one embodiment of the automatic vacuum venting sealing cap.

While this invention is susceptible of embodiment in many different forms, those shown in the drawings will herein be described in detail, with the understanding that the present disclosure is to be considered as an exemplification of principals of the invention and is not intended to limit the invention to the embodiments illustrated.

Figure 3:
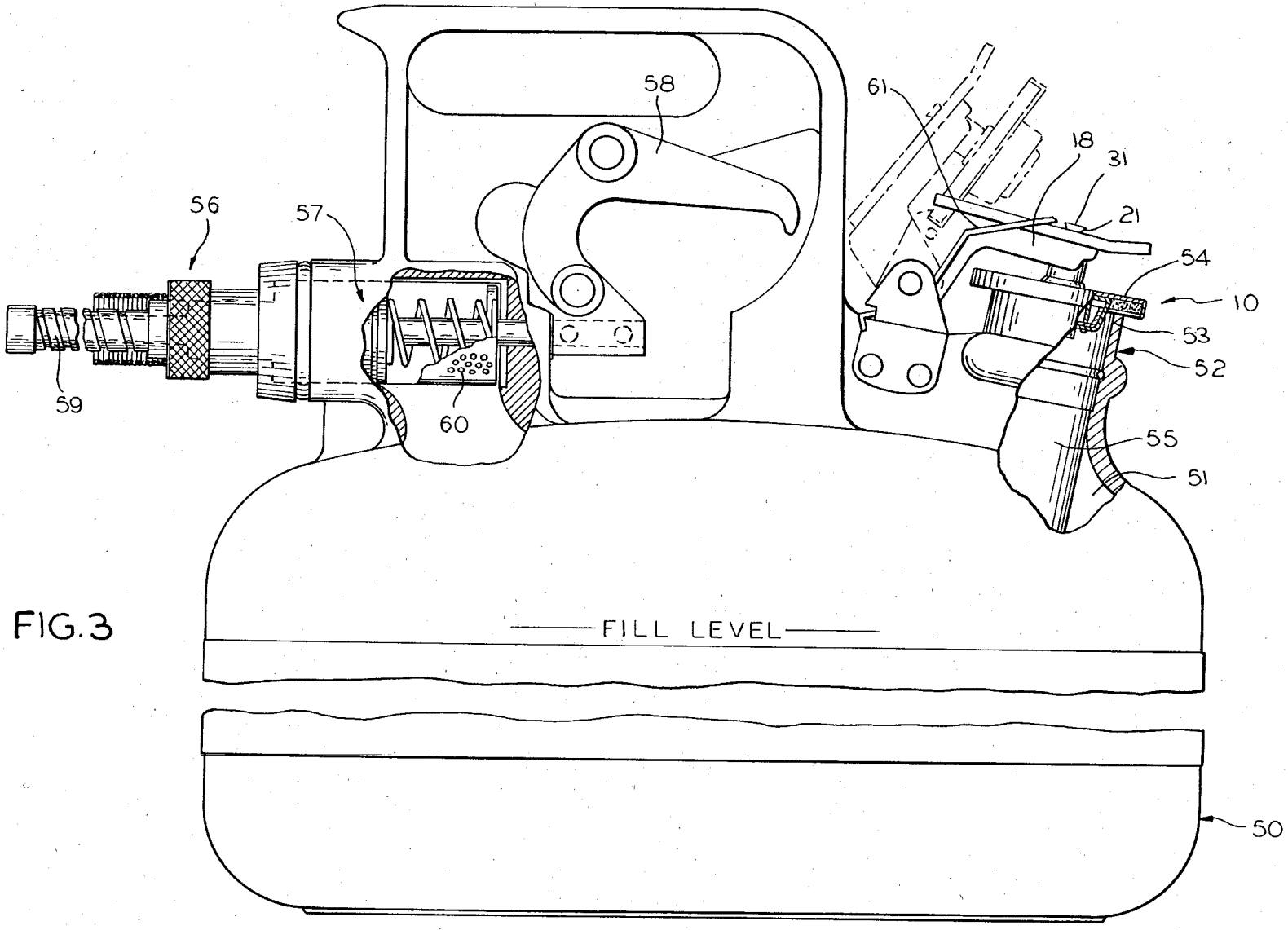
FIG. 3 is a side elevational and partially cut-away view of a Type II safety can incorporating an automatic vacuum venting sealing cap.

FIG. 1 illustrates one preferred embodiment of the automatic venting sealing cap 10 of the present invention. Specifically, the cap 10 includes a cover 11 which is preferably metallic. The cover 11 is dimensioned to be slightly larger than the upper edge 54 of the collar 53 of the fill spout 52 of the container 50, all as illustrated in FIG. 3. Cap gasket 30 is positioned within and supported by cover 11 such that a seal is formed between gasket 30 and the cover 11. The location of gasket 30 within cover 11 corresponds to the proximity of the upper edge 54 of collar 53 when the cap 10 is in a closed position, so that gasket 30 will engage the upper edge 54 of collar 53. Because of the sealing properties of gasket 30, a substantially fluid and vapor tight seal between the gasket 30 and the pour spout 52 results. Gasket 30 may preferably be formed of leather or of Accopac material CN-710 or CN-709, although it will be known in the art that other similar gasket materials may likewise be utilized.

In order to secure the cap 10 to the container 50, cap mounting means 12 are provided. As illustrated in FIGS. 1 and 3, cap mounting means 12 is attached at one end to the cover 11, such as by means of a deformed rolled lower portion 22. The other end of mounting means 12 in the preferred embodiment is adapted for flexible mounting cooperation with a cap mounting bracket 18 attached to the container 50. Specifically, cap mounting means 12 includes a hemispherical joint 16 which cooperates with a hemispherical retaining aperture 17 in the cap mounting bracket 18. A faired upper portion 21 of the cap mounting means 12 retains a mounting washer 20 whose diameter is greater than the diameter of the retaining aperture 17. Because of the loose tollerance dictated by spacing ledge 45, illustrated in FIG. 2, which is displaced a short distance above the hemispherical joint 16 and determines the spaced location of mounting washer 20 with respect to the hemispherical joint 16, cap 10 is permitted a few degrees of restricted articulation with respect to cap mounting bracket 18 so that it may automatically adjust to a proper orientation for completely sealing the fill spout 52.

Mounting bracket 18 is shown with a handle 19 to facilitate its movement for transportation of the cap 10 from a first closed position in which cap 10, by means of cap gasket 30, is in sealing engagement with pour spout 52, and a second open position in which cap 10 is disengaged from the collar 53 of the pour spout 52 to permit contents to be added or removed from the container 50. Biasing means such as cap spring 61, shown in FIG. 3, may be provided in conjunction with cap mounting bracket 18 to maintain the sealing cap 10 in the first closed position as described.

The vacuum relief function in the embodiment of the cap 10 illustrated in FIG. 1 is provided by means of a spring biased one-way valve cooperating with an air passageway within the cap mounting means 12. Specifically, the valve means includes a valve plate 25 which is biased to a closed position against a raised valve seat 24 by valve spring 27. A valve gasket 26 may be provided on the surface of the valve plate 25 between plate 25 and the raised valve seat 24 to provide an improved seal. Valve seat 24 is proximate to and surrounds the connection between the cap mounting means 12 and the cover 11. Specifically, an interior plenum 46 is defined by the valve seat 24 in conjunction with the valve plate 25 and the mounting means 12 when the valve plate 25 is in its biased closed position. This plenum 46 communicates with an air passageway 13 which passes within the cap mounting means 12. Specifically, the air passageway 13 has a first open end 15 which is located in that portion of the cap mounting means 12 which is exterior to the cover 11, such that the first open end 15 may communicate with the ambient atmosphere outside of the container 50. The passageway 13 further includes a second open end 14 which defines an aperture in the connection between the cap mounting means 12 and the cover 11. This aperture defined by the second open end 14 communicates with the interior plenum 46, such that air may pass from the atmosphere into and through the air passageway 13, including its first and second open ends 15 and 14, and thereafter into the plenum 46. Accordingly, the force exerted against the top of valve plate 25 is determined by the atmospheric pressure exterior to the container 50.

In operation, this atmospheric pressure applied to the valve plate 25 within the plenum 46 is resisted by the combined force of biasing spring 27 and the pressure exerted against the underside of valve plate 25 by the contents of container 50. When a partial vacuum arises within the container 50, a point is reached at which the atmospheric pressure acting against valve plate 25 will exceed this combined force, and valve plate 25 will be displaced against biasing spring 27 such that valve gasket 25 is disengaged from at least a portion of raised valve seat 24. The resulting opening between gasket 26 and valve seat 24 permits communication between the interior 51 of container 50 and the air plenum 46, and therefore allows passage of air through the air passageway 13 into the interior of the container to equalize pressures and alleviate the developing vacuum.

In the embodiment illustrated in FIG. 1, biasing spring 27 is maintained in a fixed position by spring retaining bracket 28 and spacer 29, which establishes a prescribed compression of biasing spring 27 to control the bias force applied and therefore determine the desired threshold of operation for the venting valve. A valve cover 23 which significantly surrounds the components of the valve element, including valve seat 24, valve plate 25, and biasing spring 27, is provided in order to protect these mechanical components.

Figure 2:
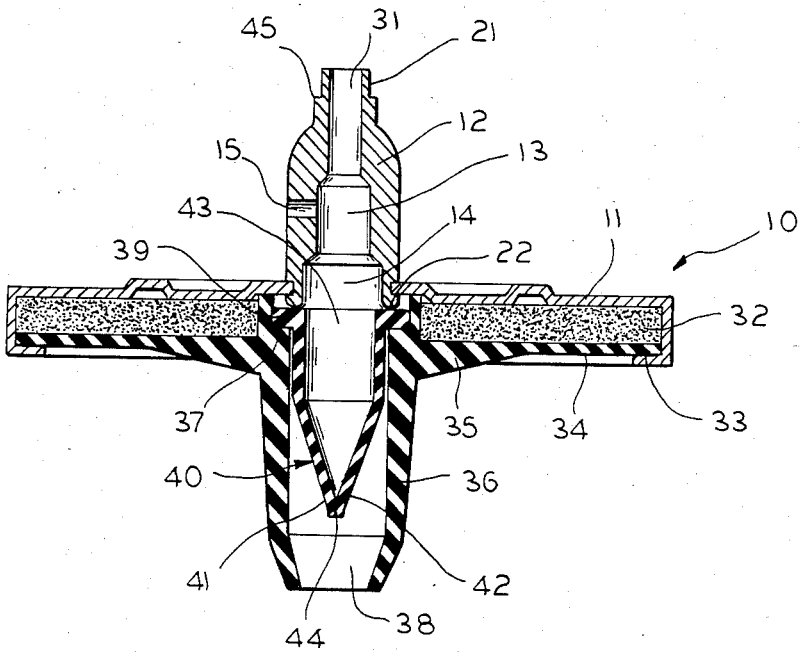
FIG. 2 is a cross-sectional view of a second embodiment of the automatic vacuum venting sealing cap, incorporating a reed valve element.

FIG. 2 illustrates a second preferred embodiment which offers the concurrent advantages of extreme simplicity and of improved corrosion resistance. Specifically, the cover 11 encloses a peripherally located deformable cushion 32. A flexible covering 34 is provided on the exterior side of cushion 32, and cooperates with the upper edge 54 of the collar 53 of the pour spout 52 of container 50 to provide a substantially fluid and vapor tight seal. Flexible covering 34 therefore cooperates with the deformable cushion 32 to provide a gasket which permits suitable sealing to the slightly irregular surface of the pour spout 52. Because flexible covering 34 may comprise a continuous impermeable plastic material, such as low density polyethylene which is highly resistant to the effect of corrosive fluids, the resulting configuration presents a substantially corrosion resistant surface of the interior 51 of the container 50 and its contents and protects the integrity of the deformable cushion 32. This cushion may preferably comprise gasket material such as Accopac NC-709 or other similar deformable gasket materials known in the art. Finally, cover 11 may preferably be formed of stainless steel to provide enhanced corrosion resistance, and may include a rolled edge portion 33 overlapping and securing the combination of the flexible covering 34 and the deformable cushion 32.

In the specific embodiment illustrated, the valve element employed is a reed or "duckbill" valve 40, including a first flanged end 39 and a second tapered end including first and second elastic reeds 41, 42. These reeds 41, 42 meet to define a flexible orifice 44, and are maintained substantially in contact with one another by means of the natural resiliency of the material comprising the reed valve 40, preferably rubber. Thus, the flexible orifice 44 is maintained in a normally closed position, preventing passage of material from the interior 51 of the container 50 through the orifice and into the interior plenum 43 defined by the body of the reed valve 40. However, because the reeds 41, 42 are elastic, the sealing contact between them at the flexible orifice 44 may be dislodged when the pressure in the interior plenum 43 against reeds 41, 42 exceeds the corresponding pressure on the exterior of the elastic reeds 41, 42. Thus, a one-way valve results. A suitable reed valve 40 as described is provided by Vernay Laboratories, Inc., Duckbill No. VA3444, although those skilled in the art will be able to utilize other similar valves or other forms of one-way valve mechanisms in connection with the present invention.

In the embodiment illustrated, the valve 40 is substantially surrounded by a protective cylindrical shroud 36, which defines at its lower end an opening 38 for permitting the flexible orifice 44 of the valve 40 to communicate with the hollow interior 51 of the container 50 when the cap 10 is in a closed position. This shroud 36 provides mechanical protection to the delicate reed valve 40, and preferably comprises corrosion resistant material such as low density polyethylene.

The upper end of the cylindrical shroud 36 is provided with a mounting ledge 37 for cooperating with the flanged end 39 of the reed valve 40 to support and mount the valve 40. The flanged end 39 of valve 40 is in contact and cooperates with the rolled lower portion 22 of the cap mounting means 12 which penetrates cover 11 and secures the mounting means 12 to the cover 11. Cooperation between the mounting ledge 37 of the cylindrical shroud 36 and the flanged end 39 of the valve 40 provides a substantially fluid and vapor tight seal between the valve 40 and the shroud 36, while similar contact in cooperation between the rolled lower portion 22 of the mounting means 12 and the flanged end 39 of the valve 40 provides a similar seal between the mounting means 12 and the valve 40 to define a substantially sealed interior plenum 43 including the interior of the valve 40 and the air passageway 13 located within the cap mounting means 12. In this manner the interior plenum 43 is substantially isolated from the interior 51 of the container 50, except for desirable one-way communication by means of flexible orifice 44.

In the specific embodiment shown, the protective shroud 36 and the flexible covering 34 comprise a single continuous and seamless member which provides maximum corrosion resistance by eliminating all seams or junctures, with the exception of the juncture between the cylindrical shroud 36 and the flange portion 39 of the valve 40 previously described. Simplicity of construction is also achieved in this manner, whereby the rolled edge portion 33 of the cover 11 secures the flexible covering 34 and concurrently secures the integral protective shroud including the valve mounting ledge 37. As illustrated, a reinforced elbow 35 may be provided to enhance the mechanical stability of the resulting structure.

In order to provide for maximum corrosion resistance, the cap mounting means 12 associated with the corrosion resistant embodiment illustrated in FIG. 2 is preferably formed of stainless steel, and includes an air passageway 13. As shown, this air passageway 13 may further include a first end communicating with the atmosphere exterior to the container by means of a hollow stem 31, wherein the hollow stem 31 further provides a cylindrical portion which may be deformably spread to provide the flaired upper portion 21 for mounting the cap 10 to a cap mounting bracket 18 as previously discussed.

FIG. 3 illustrates one specific embodiment of safety storage container utilizing the automatic venting sealing cap of the present invention. The container 50 includes a first fill spout 52 which is adapted for cooperating with the sealing cap of the present invention, and which may advantageously be utilized for sealing of the interior 51 of the container 50. A flame arrestor 55 may be provided when volatile or flammable fluids are to be handled and stored.

A second opening comprising a dispensing means 56 is also provided. Dispensing means 56 includes a control valve 57 operated by a trigger 58, such that contents may be selectively dispensed through outlet hose 59. A second flame arrestor 60 may be provided in connection with the dispensing means 56. It is seen, however, that no additional air vent opening of either a manual or of a trigger operated nature are provided or required in order to admit air into the interior 51 of the container 50 when the contents are dispensed through the dispensing means 56, because the automatic venting function of the present invention allows for admission of air into the interior 51 through the cap 10 as required.

Figure 4:
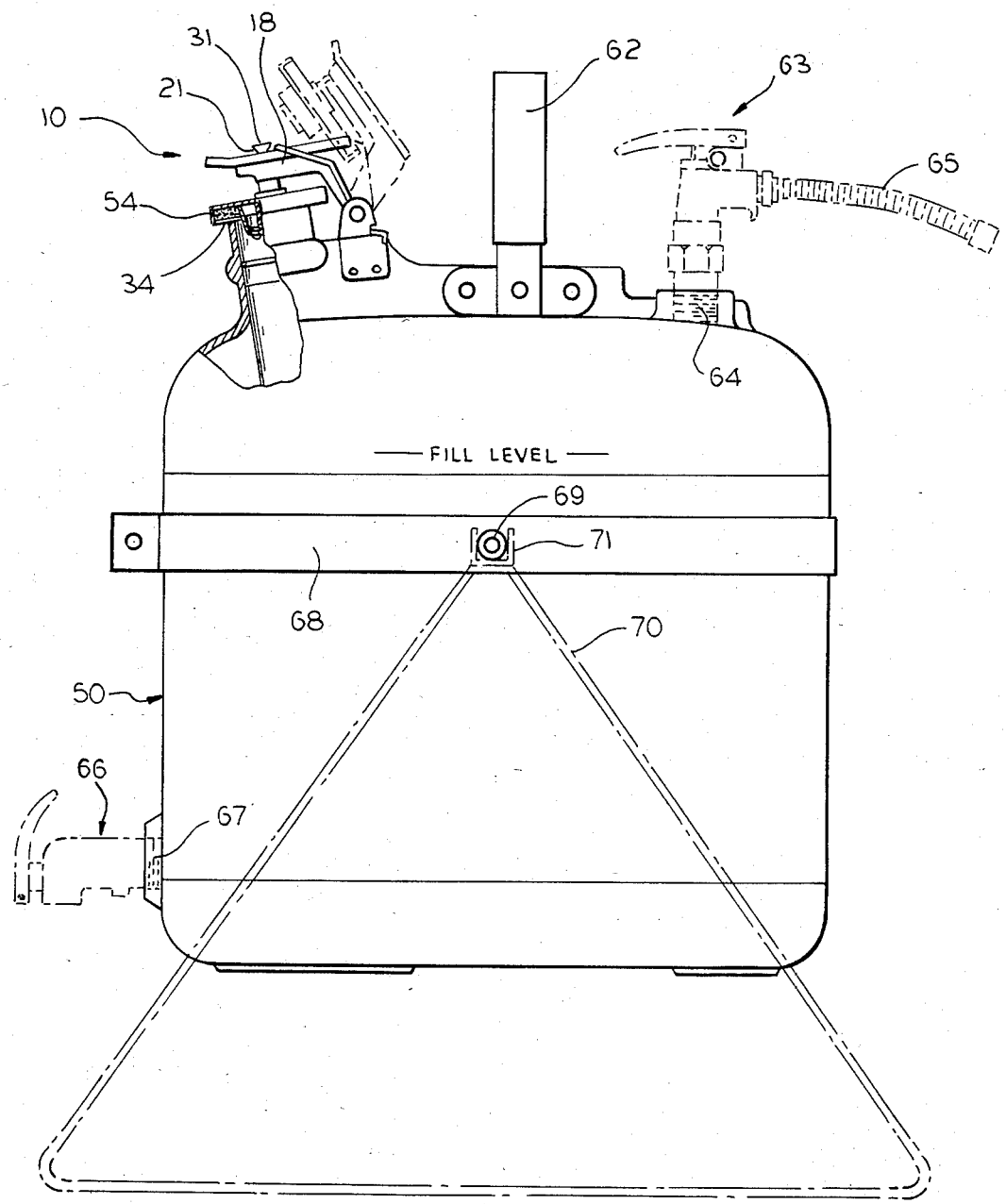
FIG. 4 is a side elevational and partially cut-away view of a laboratory can with optional top or bottom dispensing means, incorporating an automatic vacuum venting sealing cap.

FIG. 4 illustrates another embodiment of a storage container utilizing the present invention. Specifically, a laboratory can which is amenable for use as either a shelf can or as a tilt can is shown. The container 50 may include a bottom threaded opening 67 for mounting of a bottom dispensing valve 66. In this configuration, a shelf can results which may be used to dispense fluids, wherein no specialized air vent openings are required due to the incorporation of the present inventive automatic sealing cap 10 as shown. Alternatively, a top threaded opening 64 may be provided for mounting of a top dispensing means 63, which may include a flexible hose 65. In this configuration the container 50 is amenable for use as a laboratory tilt can for controlled dispensing of contents. More particularly, a support ring 68 including pivot pins 69 may be provided, wherein the pivot pins 69 rest within pivot brackets 71 on top of a tilt stand 70. The resulting container may thus be provided by means of handle 62 or otherwise to lower the top dispensing means 63 and dispense the contents of the container 50. As previously discussed, no additional specialized air vents are required in this configuration because of the automatic venting functions provided by the present inventive cap 10. The cans illustrated in FIGS. 3 and 4 may be of metal or, preferably, of plastic construction, such as high density polyethylene.

It should be understood that the present invention may be embodied in other forms than the specific preferred embodiments described above without departing from its spirit or essential characteristics. The present preferred embodiments are, therefore, to be considered in all respects as illustrative and not restrictive, the scope of the invention being indicated by the claims rather than by the foregoing description. All changes which come within the meaning and range of the equivalents of the claims, including those which would be known to those of ordinary skill in the art, are therefore intended to be embraced therein.

What is claimed is:

1. An automatic vacuum venting sealing cap for use in conjunction with safety storage containers for fluids, said cap cooperating with and substantially sealing an opening in said container when in a first engaged position, and detaching from said opening to allow substantially unrestricted access to said opening for the introduction or removal of contents of the interior of said container through said opening when said cap is in a second disengaged position, said cap including mounting means for cooperating with a mounting bracket, wherein said mounting bracket transports said cap between said engaged and said disengaged positions and retains said cap in sealing engagement with the top edge of a collar surrounding said opening when in said engaged position, said cap also including a cover whose perimeter dimensions are at least equal to the perimeter dimensions of the top edge of the collar surrounding the container opening, and further including a sealing gasket proximate to at least the periphery of the cover such that the sealing gasket is disposed between the cover and the upper edge of the collar surrounding the opening when the cap is in the engaged position, providing a substantially fluid and vapor tight seal between the cover and the collar, wherein the cover has connecting means connecting it to said mounting means and provides mechanical support for said gasket, the invention comprising:

said mounting means including an air passageway therein with a first open end which is exterior to said container when said cap is in said engaged position, and with a second open end proximate said mounting means and said cover and extending through said cover;

valve means, said valve means permitting passage of air therethrough in a first direction while substantially impeding passage of air therethrough in a second opposite direction.

said valve operably connected to said second open end of said passageway and communicating with the container opening when said cap is in said engaged position, such that said valve permits the passage of air in a forward direction into said first open end of said passageway, through said passageway, through said second open end of said passageway, through said valve means, and into the interior of said container, while substantially preventing the passage of air or contents from the interior of said container through said passageway in a second opposite direction;

said valve means including a reed valve element, said reed valve element describing a vent passageway having a flanged first end and a second end tapering from said first end, with a flexible orifice at said second end, said flanged first end of said reed valve element sealably engaged with said second open end of said air passageways to substantially prevent passage of air between said air passaageway and the interior of said container other than through said flexible orifice, said gasket including a deformable cushion proximate said cap and a flexible covering for contacting said upper edge of said collar;

and means substantially encasing said valve means for mechanically protecting said valve means from potentially damaging contact with foreign objects, said valve protection means comprising a protruding cylindrical shroud substantially surrounding said reed valve element, the first end of said shroud sealably engaging and supporting said flange end of said reed valve element, the second end of said shroud proximate said flexible orifice and providing an opening through which said orifice may communicate with the interior of said container;

said flexible covering and said shroud defining a vapor tight integral unit which, in conjunction with said reed valve element, substantially seals said container opening from passage of vapors or fluids out of said opening when said cap is in said engaged position.

2. The invention of claim 1 wherein said integral unit comprises a one-piece plastic member defining the flexible covering, the reed valve element support, and the protective shroud.

3. The invention of claim 2 wherein said plastic member is formed of low density polyethylene.

4. The invention of claim 2 wherein said one-piece plastic member is substantially impervious to corrosive fluids and vapors.

5. The invention of claim 1 wherein said integral unit comprises a one-piece plastic member defining the flexible covering, the reed valve element support, and the protective shroud.

6. The invention of claim 5 wherein said plastic member is formed of low density polyethylene.

7. The invention of claim 5 wherein said one-piece plastic member is substantially impervious to corrosive fluids and vapors.

* * * * *

UNITED STATES PATENT AND TRADEMARK OFFICE

CERTIFICATE OF CORRECTION

PATENT NO. : 4,552,288

DATED : November 12, 1985

INVENTOR(S) : Frank S. Flider

It is certified that error appears in the above-identified patent and that said Letters Patent are hereby corrected as shown below:

Col. 8, line 29: "of the interior" should be --to the interior--;

Col. 9, line 11: "passageways" should be --passageway--.

Signed and Sealed this

*Thirteenth* Day of *May 1986*

[SEAL]

*Attest:*

DONALD J. QUIGG

*Attesting Officer*

*Commissioner of Patents and Trademarks*